United States Patent [19]

de la Cruz

[11] Patent Number: 4,491,022

[45] Date of Patent: Jan. 1, 1985

[54] CONE-SHAPED CORING FOR DETERMINING THE IN SITU STATE OF STRESS IN ROCK MASSES

[75] Inventor: Rodolfo V. de la Cruz, Madison, Wis.

[73] Assignee: Wisconsin Alumni Research Foundation, Madison, Wis.

[21] Appl. No.: 467,352

[22] Filed: Feb. 17, 1983

[51] Int. Cl.[3] ..... E21B 49/00

[52] U.S. Cl. ..... 73/783; 73/784

[58] Field of Search ..... 73/783, 784, 151

[56] References Cited

U.S. PATENT DOCUMENTS

| | | |
|---|---|---|
| 2,927,459 | 3/1960 | Farrington . |
| 3,112,802 | 12/1963 | Amann et al. . |
| 3,419,077 | 12/1968 | Sanford . |
| 3,443,648 | 5/1969 | Howard . |
| 3,538,775 | 11/1970 | de la Cruz et al. . |
| 3,557,886 | 1/1971 | Cobbs . |
| 3,577,643 | 5/1971 | Schmidt . |
| 3,896,663 | 7/1975 | Ogura . |
| 3,992,928 | 11/1976 | Thoms . |
| 4,155,264 | 5/1979 | Bender et al. ..... 73/783 |
| 4,186,810 | 2/1980 | Allan . |

OTHER PUBLICATIONS

V. E. Hooker et al.: Improvements in the Three Component Borehole Deformation Gage and Overcoring Techniques, United States Department of the Interior, Bureau of Mines Report of Investigations 7894/1974.

W. G. Austin: Development of a Stress Relief Method With a Three-Directional Borehole Deformation Gage, United States Department of the Interior, Bureau of Reclamation Report REC-OCE-70-10, Mar. 1970.

*Primary Examiner*—Jerry W. Myracle

*Attorney, Agent, or Firm*—Isaksen, Lathrop, Esch, Hart & Clark

[57] ABSTRACT

The state of stress in a rock mass surrounding a borehole (21) can be estimated by measuring the initial dimensions of the borehole, cutting a cone-shaped opening extending outwardly from the borehole having a bottom wall (44), and cutting a conical slot (45) from the bottom wall (44) of the cone-shaped opening outwardly from the borehole at an angle to the axis of the borehole. The release of stress on the rock between the borehole and the conical slot results in a change in the dimensions of the borehole. An apparatus for carrying out the measurements includes one or more cutting arms (27) pivotally mounted to a main support housing (26) and capable of being rotated thereon while being pivoted outwardly to cut the cone-shaped opening. Extensible inner stems (41) fit within the cutting arms (27) and have cutting heads (40) at their ends such that when the inner stems are driven outwardly from the cutting arms (27) the cutting heads (40) will cut the conical slot to substantially relieve the stresses on the element of rock defined between the borehole (21), the bottom wall (44) of the cone-shaped opening and the slot (45). The displacements of points on the borehole wall are measured by displacement sensors 33 mounted to the main support housing at a position just below the position of the bottom wall (44).

28 Claims, 6 Drawing Figures

CONE-SHAPED CORING FOR DETERMINING THE IN SITU STATE OF STRESS IN ROCK MASSES

TECHNICAL FIELD

This invention pertains to techniques for measuring the state of stress in deep rock masses and to devices used to carry out such measurements.

BACKGROUND ART

Information on the in situ state of stress in the earth's crust is important to the proper analysis, design and construction of underground openings such as those for mining operations and for underground civilian and military installations. The suitability of a particular region of rock deep underground to such installations is significantly dependent upon the state of stress since the stress on the rock can greatly affect the stability of the rock mass. In addition, knowledge of the in situ state of stress can become critical in other applications, such as petroleum and gas extraction, the exploitation of geothermal energy from hot subsurface rocks, and the development of new methods of in situ exploitation of mineral and energy resources, as well as in earthquake studies where a thorough understanding is desired of the mechanisms of active faults and crustal strains.

Stress, a fictitious quantity, cannot be measured directly. Thus, the manifestations of stress are measured and used to estimate the stress components. For example, effects of stress that have been used or proposed for use in estimating stress in deep rock include the effect of rock stress on the velocity of sound waves, the increased secondary gamma radiation intensity absorbed with increased stress loading, and various types of strain relief methods. Estimating stress by examining the level of strain within the rock has the advantage that the strain has the same number of components as the stress and, for elastic materials, the stress and strain are directly related. Strain measurement to determine stress may be carried out by either strain relieving or strain compensation methods. The strain relieving method involves the relief of the original stress and the measurement of the deformation associated with the relieving operation. In the strain compensation method, the original stress is disturbed and the restoring pressure is measured.

Many of the currently used methods and associated devices for measuring in situ stresses were developed for mining and civil engineering applications. The method commonly utilized today for in situ stress measurements in deep rocks is hydrofracturing, which was developed to enhance production in the gas and oil industries. Hydraulic fracturing or hydrofracturing yields an average estimate of the secondary principal stresses in the plane perpendicular to the axis of the borehole. The axial principal stress in the direction of the borehole must be estimated on theoretical grounds as the weight of the superincumbent rock mass. This method, however, requires that the borehole lie along a principal stress direction. If only a single borehole is used in the measurement, the method becomes ambiguous when lateral stresses are high compared with axial stresses. Observations in the field have also indicated that there may be some inaccuracies in the magnitude and orientation of the measured stresses.

At present, hydrofracturing appears to be the only method capable of being carried out at great depths.

The overcoring method is also capable of yielding reasonably accurate measurements of stress, but is not suitable to measuring at great depth. In the overcoring method, an initial small pilot hole is drilled at the bottom of a borehole and deformation gages or strain rosettes are applied to the wall of the small pilot hole. A larger diameter borehole is then drilled, using a tubular drill, around the pilot hole to release the strain on the core of rock which surrounds the strain measurement devices in the pilot hole. The changes in dimensions of the core reveals the initial state of strain on the core which was released by the overcoring operation, which can then be used to estimate the initial level of stress in the region of the core. A principal limitation of the overcoring technique is that it is difficult to perform in deep holes, in part because the wires connected to the sensors extend through rotating drill pipe and are subject to tangling as the pipe rotates. A number of other limitations of the overcoring method have also been noted. It must, of course, be performed at the bottom of a drilled hole, eliminating the possibility of using existing holes which are deeper than the depth at which tests are desired. In addition, since the original drilling of the hole released the vertical pressure on the rock directly beneath the bottom of the hole, the stress field measured by the overcoring technique is primarily that which is substantially perpendicular to the axis of the hole. Thus the readings obtained by the overcoring technique may not be accurately related to the actual state of stress in the surrounding rock. The overcoring technique is also relatively expensive since it requires an entire drill rig and crew. Even where tests are to be performed on a preexisting hole, a drill rig must be brought to the site of the hole so that the overcoring operation can be performed at the bottom of the preexisting hole.

Other, more recently developed methods for measuring stress are the borehole deepening method, sidehole overcoring method and jack fracturing method.

In the borehole deepening method, the diametral deformations of the wall close to the bottom of the borehole are measured while the hole is being deepened with a specially designed tapered drill bit, as illustrated in U.S. Pat. No. 3,538,755. The method has been successful in near surface and tunnel-driving measurements, but encounters technical difficulties in measurements in deeper holes. In the sidehole drilling method, the borehole walls are first instrumented with electrical resistance strain gauges. Small holes are then drilled over or under the strain gauges in the borehole wall to relieve the stresses. Both the relieving process and the strain-relief measuring process are difficult to carry out with this method, especially at great depths and in severe borehole environments. In the jack fracturing method, as shown in U.S. Pat. No. 3,961,524, friction strain gauge rosettes are first applied to the borehole wall. The wall adjacent the strain gauges is then fractured by unidirectional loading with a borehole jack. With the fractures kept open under pressure, the stresses in the rock adjacent the wall are relieved and the change in the borehole wall dimensions can be detected by the strain gauges. The in situ state of stress can then be calculated from the strain gauge signals using elastic theory. While this method has been used successfully at shallow depths, its performance at great depths has not yet been established.

SUMMARY OF THE INVENTION

In accordance with the present invention, displacement sensors are positioned on the wall of a borehole in a location at which stress measurements are desired. The sensors may be built to measure changes in the spacing of selected points on the borehole wall: radial displacement of points on a diameter of the hole, displacements of axially spaced points on the hole wall, or a combination of such displacements. A circumferential cut is then made in the wall of the borehole above or below the sensors to form a cone-shaped opening which extends outwardly from the borehole. A cone-shaped slot is then drilled outwardly at an angle to the axis of the borehole from the bottom of the cone-shaped opening so that the cone-shaped slot extends toward and past the location of the sensors. When the slot extends sufficiently past the sensors, the loading on the cone-shaped element defined between the slot and the borehole will be relieved, and the borehole at the sensors will change slightly in dimension as the strain on the element is released. The change in dimensions as measured by the sensors can be used to calculate the initial state of stress in the vicinity of the position in which the measurements are made.

The cutting of the cone-shaped opening initially releases the axial loading on the region of rock at which the sensors are placed, while the cutting of the conical slot releases all remaining stress on the element enclosed by the slot. A similar, single step release of loading on the region of rock at the sensors can be accomplished by cutting a cone-shaped slot directly into the wall of the borehole at a position proximate to the sensors to effect a continuous release of both axial and radial strains on the core of the material left within the cone-shaped slot. Alternatively, the cutting of the cone-shaped opening by itself allows measurement of the release of the axial component of stress.

The method allows the in situ stress to be measured at any point in a borehole, not just at the bottom of the hole. Thus, this method is especially adapted for performance on preexisting boreholes, and allows tests to be made on holes which have been drilled to depths greater than that at which measurements are desired. The stress measurements in accordance with this method may also be carried out where conventional overcoring methods are infeasible. It has the additional advantage over standard overcoring techniques that the region of the borehole at which the displacement sensors are placed is initially subjected to both axial and radial stress components, which are both released by the cutting of the cone-shaped slot from the borehole or the two step cutting of the cone-shaped opening and the outwardly extending conical slot. In contrast, the stress on the bottom of the borehole in the standard overcoring technique is substantially released before the pilot hole is drilled into the core, so that accurate measurements of axial stress fields are not easily obtainable.

Preferred apparatus for carrying out the invention includes an elongated main support housing which is adapted to be inserted and suspended in a borehole, a cutting arm or arms pivotally mounted to an axially stationary but rotatable base bearing, a motor driven linkage for extending the cutting arms outward about their pivotal connection to the stationary base, and a drive motor for rotating the cutting arms about the axis of the support housing. The outer surfaces of the cutting arms have drill bits, such as diamond bits, formed thereon so that as the arms are pushed outwardly into contact with the wall of the borehole, they will grind away the material of the walls to form the initial cone-shaped opening in the sides of the wall. After the opening has been widened to a desired extent, e.g. 15° from the axis of the borehole, a cutting head mounted on the end of an extensible inner stem, telescopingly received in each cutting arm, is extended outwardly to grind the conical slot in the rock material as the cutting arms are rotated.

The apparatus may include both diametral deformation sensors, which sense a change in the diameter of the borehole before and after the cutting operations, and axial and circumferential deformation gauges, such as frictional strain gauges. The sensors are mounted to the support housing at a position adjacent to and beneath the folded position of the cutting head when the cutting arms are withdrawn toward the support housing, so that the sensors will be able to detect deformations of the adjacent region of rock as it is separated from the surrounding rock mass by the advancing cutting head which forms the conical slot.

The cone-shaped coring apparatus in accordance with the invention is preferably built to be self-contained and self-powered, so that an entire drill rig is not required to drive the apparatus. Unlike conventional overcoring drills, the conical coring apparatus can be used to make stress measurements in existing boreholes at any desired depth, thereby greatly reducing the cost required to obtain stress measurements since no drilling is needed at all if an existing borehole is tested.

The structure of the device, and its self-contained positioning and driving capability, adapt it to testing of stress levels at greater depths than are now possible with overcoring techniques. Since the apparatus is not positioned and driven from the surface with a long string of drill pipe sections, positioning is simplified. The apparatus can be centrally aligned within the borehole with the aid of standard centralizer springs, using expanding borehole jack shoes to stabilize the apparatus if desired, and the absolute spatial orientation of the coring apparatus can be monitored by mounting a position sensing device, such as a gyroscope, to the support housing.

It is further apparent that the apparatus of the invention can also be utilized for purposes other than stress testing, as, for example, to expand a borehole to increase the wall area for seepage of oil, water or gas into the borehole, or to form reservoirs to hold oil or water.

Further objects, features and advantages of the invention will be apparent from the following detailed description when taken in conjunction with the accompanying drawings showing a conical borehole coring apparatus in accordance with the invention.

BEST MODE FOR CARRYING OUT THE INVENTION

Figure 1:
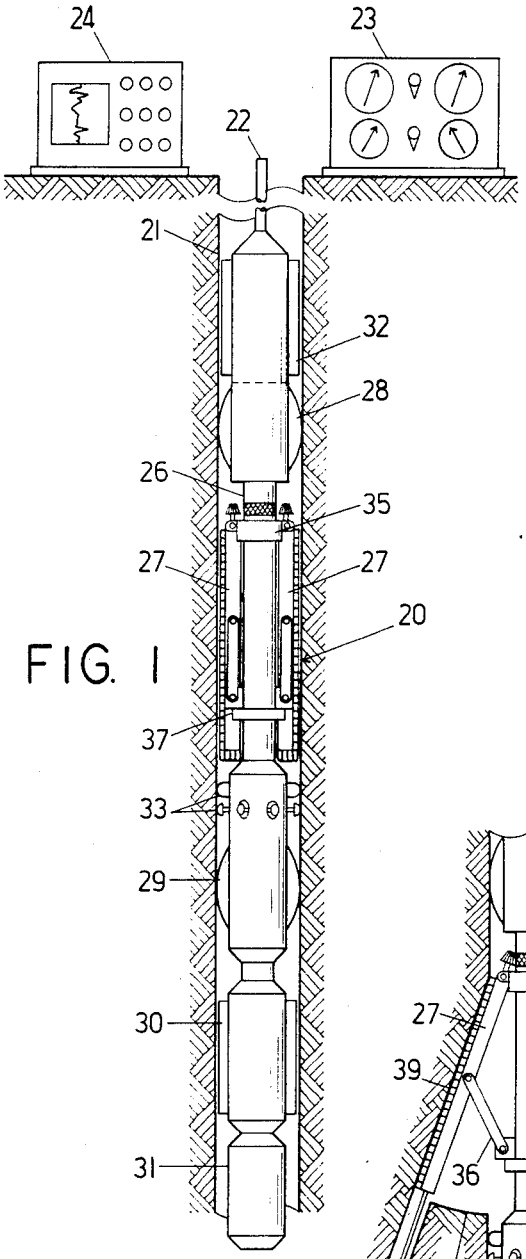
FIG. 1 is a schematic view of a conical coring apparatus in accordance with the invention shown within a borehole.

With reference to the drawings, a conical coring apparatus in accordance with the invention is shown generally at 20 in FIG. 1 placed in a borehole illustrated at 21. The cutting apparatus 20 is suspended from the surface in a desired location in the borehole by a cable 22 which also includes electrical conductors and any pneumatic or hydraulic lines as necessary to operate the apparatus. These lines are connected to a surface controller 23, which includes the necessary electrical power supply, switches, gauges, and any hydraulic or pneumatic sources, with associated valves. The output signal lines from the drilling apparatus are also connected to a signal conditioner and recorder 24.

The drilling apparatus 20 has a generally tubular, elongated main support housing 26 to which are mounted extendable cutting arms 27. A centralizer-locating mechanism 28, of standard design, is mounted to the main support housing 26 at a position above the cutting arms 27, while a second, similar centralizer and locating mechanism 29 is mounted to the support housing below the cutting arms 27. The centralizer and locating mechanisms 28 and 29, which are shown schematically in FIGS. 1-3, serve to centrally locate the support housing 26 within the borehole when the bands of the centralizer mechanisms are expanded against the walls of the borehole. The apparatus also preferably includes pairs of radially extendable bearing shoes 30 and 32, mounted to the support housing 26 at positions below and above the centralizer mechanisms 28 and 29, respectively, which are operated either hydraulically or pneumatically to press against the sides of the borehole and lock the support housing in position to prevent axial and rotational movement of the support housing. An orienting device 31, such as a gyroscope, is also preferably mounted to the support housing at the bottom thereof to provide an output signal which indicates the absolute orientation of the support housing within the borehole. Such information concerning the orientation of the apparatus 20 within the borehole allows the direction of the stress to be determined precisely.

To measure the deformations in the borehole that occur as the stress on the borehole wall is released, the strain or deformation sensors 33 are mounted to the support housing 26 at a position just below the cutting arms 27. As explained further below, the sensors 33 measure the changes in the separation of axially, radially, or circumferentially spaced points on the borehole wall.

Figure 3:
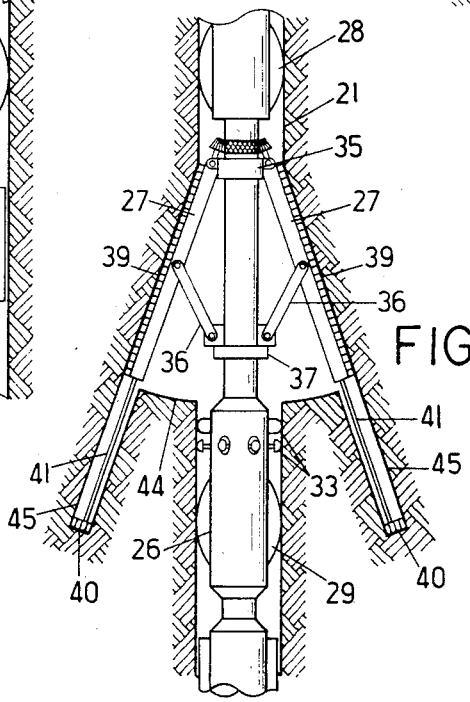
FIG. 3 is a view showing the cutting head and extension rods extended to cut a conical slot in the region of rock surrounding the displacement sensors.

The cutting arms 27 are pivotally mounted to the support housing at their top ends by an axially stationary, circumferentially rotatable base 35. Brace links 36 are pivotally connected to a midpoint on the cutting arms 27 at one end of each link and are pivotally connected at the other end of the link to an axially movable, rotatable base 37. As the movable base 37 is driven upwardly, the cutting arms 27 will be driven outwardly against the walls of the borehole, and they can be rotated about the axis of the elongated main support housing by driving the rotatable base 35. Rock cutting bits 39 are arrayed along the outer surfaces of the cutting arms 27 so that the borehole wall will be cut away as the arms 27 are forced into contact with the wall. A cutting head 40 is located at the bottom of each cutting arm 27 in its initial position and is mounted for inward and outward movement with respect to the arms 27 on an inner stem 41, as shown in FIG. 3. Each cutting head 40 is studded with cutting bits, such as diamond bits, and is adapted to cut both radially outwardly and downwardly.

Figure 2:
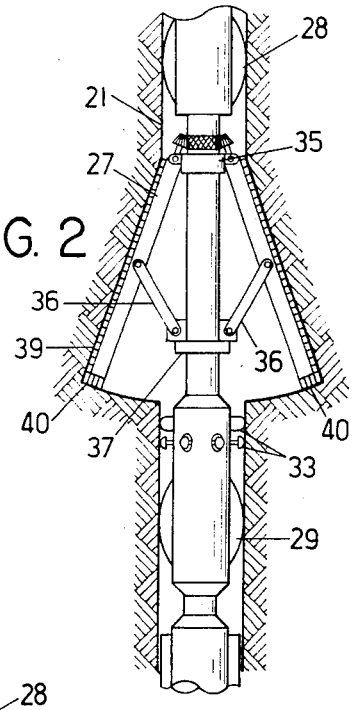
FIG. 2 is a view of the apparatus in FIG. 1 with the cutting arms expanded to cut a cone-shaped opening in the borehole wall.

The method of determining the stress level of a rock formation underground is illustrated with reference to the sequence of FIGS. 1-3. As shown in FIG. 1, the apparatus 20 is first lowered down into a borehole with its cutting arms 27 folded in, the centralizer mechanisms 28 and 29 and the bearing shoes 30 and 32 drawn inwardly, and the sensors 33 also withdrawn, so that the entire apparatus is capable of being freely dropped down the borehole 21 without undue frictional engagement between the apparatus and the wall of the borehole. The borehole 21 may be either a preexisting hole, such as one drilled for oil and gas exploration, or a borehole drilled specifically for the purpose of geological stress measurements. In either case, the drilling equipment is removed from the borehole and the apparatus 20 is dropped into the hole and lowered by gravity to a depth at which it is desired to take stress measurements. When the apparatus is at the desired depth, the centralizer mechanisms 28 and 29 are expanded to properly locate the apparatus within the borehole, and the bearing shoes 30 and 32 are driven outwardly to hold the apparatus in place. The sensors 33 are then also driven outwardly to make contact with the wall of the borehole and are activated to provide an initial strain reading on the borehole. For example, the sensors responsive to radial deformations of the borehole would provide an initial diameter reading (i.e., radial separation) of the borehole along at least one diameter and preferably along several diameters of the borehole, while the axial and circumferential sensors would generally locate axially and circumferentially spaced points on the borehole and would measure the initial separation between these points. Sensors which measure strain changes other than by displacement of points on the borehole wall may also be utilized. The various elements of the apparatus 20 are now in their positions to begin the cutting operation, as illustrated in FIG. 1.

The axially movable base 37 is then driven upwardly, transmitting an outward force through the links 36 to the arms 27, and the axially stationary base 35 is rotated to drive the arms 27 around the main support housing 26. As the arms 27 cut away the surrounding rock or earth, a cone-shaped opening is formed around the borehole. This cone-shaped opening has a concave bottom wall 44 which preferably begins at a point on the borehole just above the location of the displacment sensors 33. The debris produced by the drilling action of the rotating cutting arms 27 can be removed in a conventional fashion from the vicinity of the sensors and the cutting arms 27 to minimize interference by such material with the cutting operation and the measurement of the borehole dimensions.

The cone-shaped opening is expanded to a desired conical angle, which, for purposes of obtaining displacement measurements with the sensors 33 may preferably be of approximately 15°. As is apparent from the view of FIG. 2, stresses on the rock surrounding the sensors 33 which are in the direction of the axis of the borehole will be substantially released after the cone-shaped opening has been formed. These deformations will be detected by the sensors 33 as a displacement from the initial positions recorded by the sensors before cutting operations began on the borehole.

Upon reaching the desired outermost conical angle of the cone-shaped opening, further outward expansion of the cutting arms is halted and the arms are held firmly at the desired angle by the links 36. As the cutting arms continue to rotate, the cutting heads 40 are driven downwardly to begin to cut a conical slot 45 surrounding the sensors 33. Cutting of the slot is continued until the bottom of the slot is advanced well beyond the sensors 33, preferably at least one diameter along the axis of the borehole beyond the position of the sensors. At such a depth of the slot 45, substantially all of the stress has been relieved on the element of rock adjacent the bottom wall 44 between the walls of the slot 45 and the borehole wall, and the displacement sensors 33 are then able to provide a measurement indicating the relieved dimensions of the borehole. The relieved dimensions may be compared with the original dimensions measured by the sensors to provide a measurement of the strain released, which in turn can be used to estimate the original stress on the borehole. Thus, the above described two step process allows the axial component of stress to be estimated from the measurements by the sensors 33 during the first step of cutting a cone shaped opening, while the second step of cutting the surrounding slot 45 allows the sensors 33 to provide measurements from which the other stress components can be estimated.

As an alternative to the two step process of forming a conical opening and then drilling a conical slot from the bottom of the conical opening, a single step stress relieving process in which a conical slot is drilled directly into the borehole wall may also be carried out. The apparatus 20 may be utilized to drill such a conical slot directly into the borehole wall where the borehole diameter is substantially larger than the diameter of the apparatus 20; e.g., where the borehole diameter is substantially equal to an outward extension angle of 15° of the arms 27, and where the sensors 33 can be extended to reach the wall of the borehole. A conical slot may then be drilled directly into the borehole wall by simply extending the cutting heads 40 on the extension rods 41 to cut the opening in the wall of the borehole as the cutting arms are rotated.

Of course, the foregoing illustrations of the cutting of the cone-shaped opening and conical slot in the borehole wall assumes that the material surrounding the borehole is stable and capable of being self-supporting when the slot is formed therein, which will typically be the case for openings cut in underground rock formations.

Figure 4:
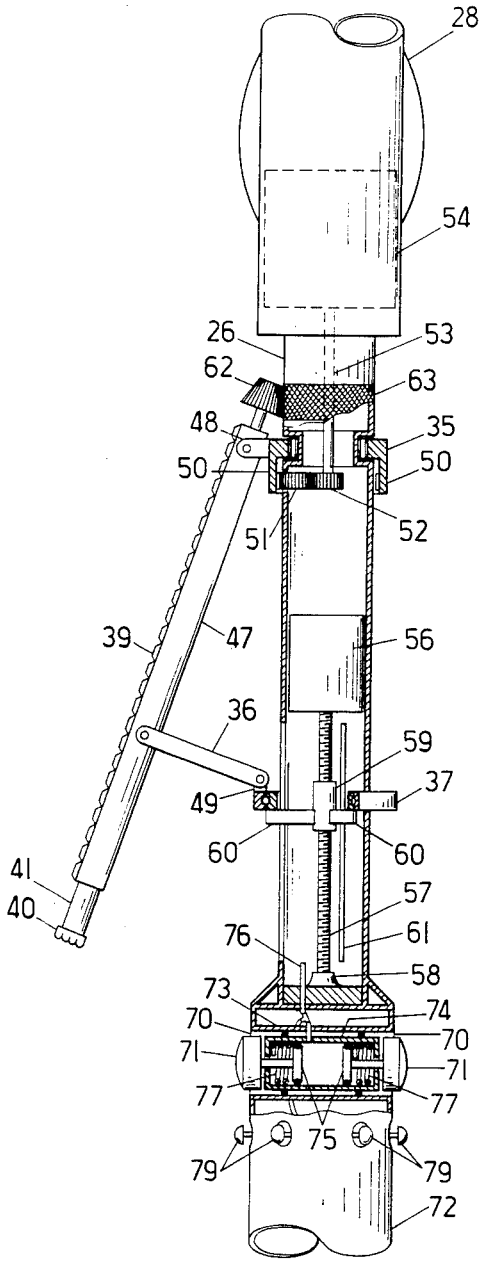
FIG. 4 is a more detailed view, partially in cross-section, of the main support housing and one cutter arm of the apparatus in FIG. 1.

A more detailed view of the construction and operation of the pivotally extensible cutting arms 27 is shown in FIG. 4. One such cutting arm is shown in FIG. 4, although it is understood that more than one arm could be mounted to rotate about the main housing 26, such as the two cutting arms illustrated in the views of FIG. 1–3, and three equally spaced arms 27 are preferred for rotational stability. Each of the cutting arms 27 includes a tubular outer stem 47 pivotally connected to a bracket 48 which is itself attached to the rotating, axially stationary base 35. The connection of the bracket 48 to the stem 47 is at a point on the stem spaced a short distance from one end of the stem. The brace link 36 is also pivotally connected to the tubular stem 47 at an intermediate point along the stem, preferably closer to the free end, and is pivotally mounted to a bracket 49 at its other end which is mounted to the axially movable base 37.

The stationary base 35 is formed of an inner, stationary bearing portion, preferably indented into the housing as shown, and an outer, rotatable bearing portion. The bracket 48 is mounted to the outer bearing portion and rotates with it about the housing. The rotatable bearing portion of the base 35 has secured to it a ring gear 50, having internally directed gear teeth (not shown) which mates with a first pinion gear 51. The gear 51 is mated with a second pinion drive gear 52 mounted on the end of a shaft 53 driven by an electric drive motor 54. Power from the motor 54 will be transmitted through the pinion gears 52 and 51 to the ring gear 50 and thence to the outer bearing portion of the base 35 to rotate the arms 27 around the main housing 26.

The movable base 37 also has an inner, stationary bearing portion and an outer, rotatable bearing portion. The base 37 is driven upwardly and downwardly, to consequently drive the arms 27 outwardly and inwardly, by means of a motor 56 which has its output shaft connected to an elongated jack screw 57 which rotates in a bottom socket 58. A threaded sleeve 59 moves upwardly and downwardly on the ball screw 57 as it rotates. Radially extending brackets 60 are mounted at one of their ends to the sleeve 59 and extend outwardly through slots 61 where they are attached to and support the inner, stationary bearing portion of the movable base 37. Thus, rotation of the electic drive motor 56, turning the shaft 57, will raise or lower the base 37, thereby transmitting force through the link 36 to pivotally rotate the arms 27 inwardly and outwardly depending on the direction of rotation of the jack screw shaft 57. The motors 54 and 56 are preferably electrical motors supplied with electricity through wires (not shown) extending through the cable 22 to the surface equipment, but may also be hydraulic motors which are driven by hydraulic fluid under pressure supplied through the cable 22 from the surface.

The cutting arm 27 has a beveled drive pinion 62 mounted at its top end in position to engage a drive band 63 which extends around the circumference of the main housing 26 at a position adjacent the pinion 62. As is apparent from an examination of FIG. 4, when the cutting arm 27 is in its retracted position adjacent to the main housing 26, the drive pinion 62 will be out of contact with the band 63. As the cutting arm 27 is pivoted outwardly, the pinion 62 will eventually be forced into contact with the band 63, providing a positive, mechanical limit on the outward extension of the arms 27. The contact between the band 63 and the pinion 62 will cause the pinion to be rotated with respect to the outer stem 47 of each cutting arm as the arms are rotated about the main housing. The band 63 and the material forming the outer surface of the drive pinion 62 may both be selected to have significant frictional or frictional/mechanical engagement properties under the adverse conditions (e.g., heat, water, mud, oil, etc.) of the borehole. In an alternative embodiment, the band 63 may be replaced with a ring gear having outwardly extending teeth and the drive pinion 62 may similarly be formed as a pinion gear.

Figure 5:
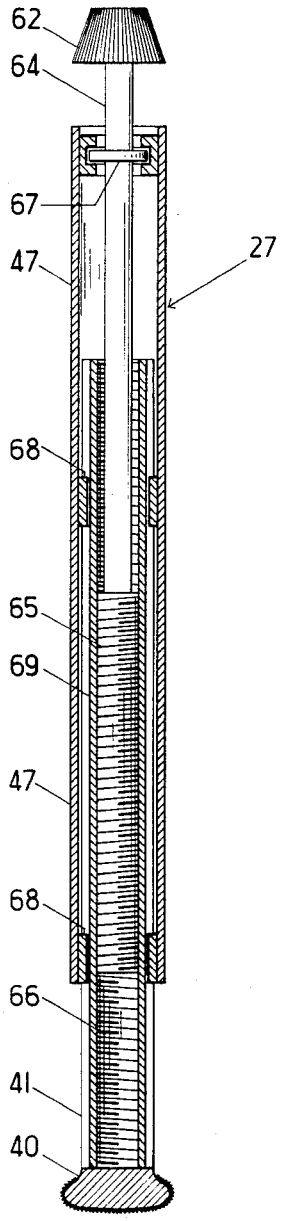
FIG. 5 is a detailed cross-sectional view of the cutting arm with extension rod and cutting head partially extended.

The effect of the rotation of the drive pinion 62 is illustrated in FIG. 5, which is a cross-section of one cutting arm 27. The other cutting arms are identically constructed. The drive pinion 62 is mounted to the end of a rod 64 which extends into the outer stem 47. The rod 64 has outwardly extending threads 65 formed on its surface over a portion of its length near its free end. The inner stem 41 is tubular and hollow and has threads 66 formed on its inner surface which engage the threads 65 on the rod 64 so that rotation of the rod 64 with respect to the inner stem 41 will cause the inner stem 41 to be driven inwardly or outwardly depending on the direction of rotation of the rod 64. The rod 64 is held for rotation by a flange 67 extending from the rod 64 which fits within a mating channel in a bushing formed on the inner suface of the outer stem 47. Bushings 68 mounted at the middle and lower or free end of the outer stem 47 within the hollow interior thereof firmly engage the inner stem 41 to hold it and support it against sideways forces that may be applied to the rod. The bushings 68 may also include inwardly extending keys (shown in cross-section) which engage keyways 69 formed longitudinally in the extensible inner stem 41 to prevent the inner stem 41 from turning with respect to the outer stem 47. However, even if a key and keyway are not provided, the frictional engagement between the cutter head 40 and the walls of the slot which it is cutting will tend to resist rotation of the inner stem 41 and thereby will cause the torque applied by the pinion 62 to drive the inner stem outwardly during initial cutting of the slot. The inner stem may be drawn back into the outer stem 47 by reversing the direction of rotation of the cutting arms 27 with respect to the housing.

Other means may also be utilized to drive the inner stem 41 inwardly and outwardly, such as a hydraulic ram which drives the inner stem 41 when supplied with hydraulic fluid from a pump. A pneumatic drive may also be utilized.

Figure 6:
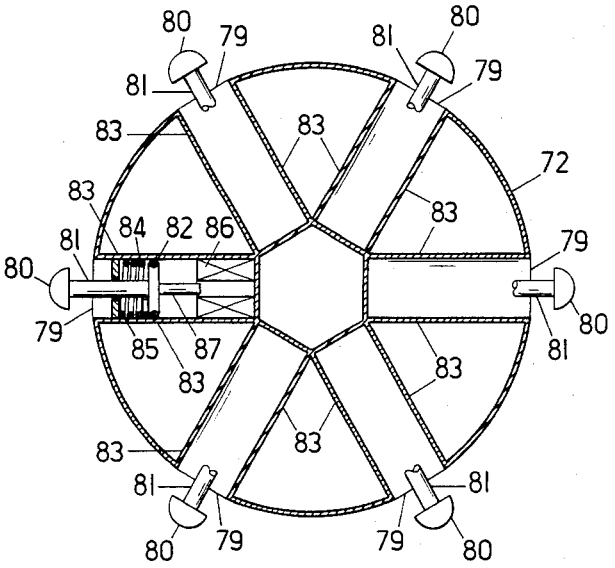
FIG. 6 is a cross-sectional view of the diametral deformation sensors taken generally along the line 6—6 of FIG. 4.

As noted above, the displacement sensors 33 are preferably capable of measuring deformations in the borehole which occur in its radial, axial and circumferential dimensions, although useful information may be provided when only one or two of the dimensional changes are recorded. Illustrative displacement sensors are shown in more detail in FIG. 4. To sense axial and circumferential deformations, a pair of radially extendable shoes 70 having frictional strain gauges on the faces thereof are mounted within the lower, expanded portion 72 of the main housing in a cylindrical channel 73, and are driven outwardly by air pressure supplied to a cylindrical case 74 between pistons 75 which are connected to the shoes 70. The air under pressure to the cavity is selectively supplied through an airline 76 to drive the shoes outwardly into firm engagement with the walls of the borehole, and the shoes and pistons are retracted by compression springs 77 when the air pressure is removed. The strain gauge displacement sensors 71, preferably both axially and circumferentially oriented to measure changes in the separation of axially and circumferentially spaced points, are carried on the outer surfaces of the shoes 70 to sense the changes in the dimensions of borehole wall when pressed tightly there against. These sensors will transmit a signal indicative of the dimensional changes back through wires (not shown) to the surface, in the manner described in the aforesaid U.S. Pat. No. 3,961,524. Radial deformations of the borehole are sensed by extendable radial probes 79 which are arrayed in even spacing about the circumference of the lower portion 72 of the main housing. The arrangement of these probes is shown in the cross-sectional view of FIG. 6, wherein one of the probes is illustrated in detail. Each probe has a rounded probe head 80 extending from a stem 81. Each of the stems 81 is connected to a piston 82 which rides within a cylinder 83. These cylinders are spaced evenly around the periphery of the lower housing portion 72 and may be formed to meet at their inner ends as illustrated in FIG. 6. The probe heads 80 are normally held inwardly within the outer periphery of the lower housing 72 by the force of a spring 84 which is compressed between the pistons 82 and an inwardly extending wall 85 mounted to the interior of the cylinder 83. When the apparatus is in position to take measurements, air under pressure is supplied through the tube 76 and connecting tubes (not shown) to the interior of each of the cylinders 83 behind the pistons 82 to resiliently urge the pistons and the probe heads outwardly until the probe heads make contact with the wall of the borehole and are resiliently held thereagainst. The positions of the probe heads 80 relative to the main housing are measured by position transducers such as the linear variable differential transformer (LVDT) shown in FIG. 6—having a coil 86 and a core 87 which moves inwardly and outwardly within the coil and is connected to the piston 82. When the coil 86 is properly excited, the output of the LVDT coil will be proportional to the position of the core 87 within it, and will thus be proportional to the relative position of each of the probe heads 80. Although the details of the probe 79 are shown only with respect to one of the probes of FIG. 6, all the other probes have similar constructions and, thus, each probe is capable of independently monitoring the particular position of the borehole with which it is in contact with respect to the main housing position. By utilizing the six independently movable probes 79 shown in FIG. 6, it is possible to measure any changes in the radial dimensions of the borehole along three diameters of the borehole at equally spaced angles.

It is apparent that variations on the apparatus 20 may be utilized in carrying out the method of the invention without departing from the essentials thereof. For example, other means for cutting the conical slot may be utilized. Such means include movable hydraulic drilling heads which employ water or mixtures of water and other materials to drill the slot into the side of the borehole. In addition, the apparatus 20 can be modified so that the cutting of the initial cone-shaped opening is not necessary, and a conical slot can be formed directly in the wall of the borehole. For example, the mechanism could be modified so that the cutting arms 27 are pivotally mounted at their mid-points to a point at the center of the main support housing 26 so that the cutting arms will pivot outwardly in criss-cross fashion to allow the cutter heads 40 to engage the side of the borehole at the desired angle of conical cut into the borehole wall. Also, it is apparent that the apparatus 20 could be fixedly mounted to the lower end of a drill pipe, with cutting obtained by fixing the cutting arms 27 with respect to the main housing 26 and rotating the housing by rotating the drill pipe from the surface.

It is understood that the invention is not confined to the particular construction and arrangement of parts and the detailed steps described herein, but embraces such modified forms thereof as come within the scope of the following claims.

What is claimed is:

1. A method of relieving the stress on a selected segment of a borehole drilled into an earth mass comprising the steps of:

(a) cutting a cone-shaped opening which extends outwardly from the borehole and which has a generally radially extending bottom wall;

(b) cutting a conical slot in the bottom wall of the cone-shaped opening which extends outwardly from the borehole at an angle to the axis thereof, to thereby provide an element of earth mass which is relieved from the stresses imposed on the mass surrounding the borehole and which is defined between the wall of the borehole, the bottom wall of the cone-shaped opening, and the walls of the conical slot.

2. The method of claim 1 including the steps of measuring the difference in the strain in the earth mass adjacent the borehole wall before and after the steps of cutting the conical opening and the conical slot.

3. The method of claim 1 including, before the other steps, the step of measuring the separation of two points on the borehole wall at a selected location on the wall just below the position at which the bottom wall of the cone-shaped opening will be cut and measuring the separation of the points on the borehole wall at the selected location after the cone-shaped opening and conical slot are cut, whereby the difference in the separation of the selected points on the borehole wall may be related to the release of strain in the material adjacent the borehole wall which is itself indicative of the state of initial stress in such material.

4. The method of claim 1 including, before the other steps, the step of measuring the initial separation of points on the borehole wall on at least one diameter of the borehole at a position just beneath that at which the bottom wall of the cone-shaped opening will be cut, and measuring the separation of the points on the diameter after the cone-shaped opening and conical slot have been cut, whereby the change in the separation of the points may be related to the release of strain in the material adjacent to the borehole wall which is itself indicative of the state of initial stress in such material.

5. The method of claim 4 wherein the separation of points on the borehole wall is measured at a plurality of diameters of the borehole wall arrayed uniformly about the periphery of the borehole wall before and after the cone-shaped opening and conical slot are cut.

6. The method of claim 1 including, before the other steps, the steps of pressing at least one strain gauge into firm contact with the borehole wall such that points on the strain gauge engage points on the borehole wall and obtaining an initial measurement from the strain gauge, and obtaining a measurement from the strain gauge after the cone-shaped opening and conical slot have been cut which is indicative of the change in strain on the borehole wall material, which may be related to the release of stress in the material adjacent the borehole.

7. The method of claim 1 including, before the other steps, the step of measuring the separation of axially and radially spaced points on the borehole wall at a location just beneath the position at which the bottom wall of the cone-shaped opening will be cut, and measuring the separation between the axially and the radially spaced points on the borehole wall after the cone-shaped opening and conical slot have been cut, whereby the change in separation of the axially and radially spaced points may be related to the release of strain in radial and axial directions on the material surrounding the borehole and which may be further related to the release of stress on the material.

8. The method of claim 1 wherein the step of measuring the strain includes the steps of measuring the separation of axially and radially spaced points on the borehole wall at a location just beneath the position at which the bottom wall of the cone-shaped opening will be cut, and measuring the separation between the axially and the radially spaced points on the borehole wall after the cone-shaped opening has been cut, whereby the change in separation of the axially and radially spaced points may be related to the release of strain in radial and axial directions on the material surrounding the borehole and which may be further related to the release of stress on the material.

9. A method of estimating the strain in the material surrounding a borehole in an earth mass, comprising the steps of:

(a) cutting a cone-shaped opening extending outwardly from the borehole wall at a selected location on the borehole wall, the cone-shaped opening having a generally radially extending bottom wall;

(b) measuring the strain in the earth mass surrounding the borehole wall at a position in the wall just beneath the position of the bottom wall of the cone-shaped opening before and after the cone-shaped opening is cut.

10. The method of claim 9 wherein the step of measuring the strain includes the steps of measuring the separation of two points on the borehole wall at a selected location on the wall just below the position at which the bottom wall of the cone-shaped opening will be cut and measuring the separation of the points on the borehole wall at the selected location after the cone-shaped opening is cut, whereby the difference in the separation of the selected points on the borehole wall may be related to the release of strain in the material adjacent the borehole wall which is itself indicative of the state of initial stress in such material.

11. The method of claim 9 wherein the step of measuring the strain includes the steps of measuring the initial separation of points on the borehole wall on at least one diameter of the borehole at a position just beneath that at which the bottom wall of the cone-shaped opening will be cut, and measuring the separation of the points on the diameter after the cone-shaped opening has been cut, whereby the change in the separation of the points may be related to the release of strain in the material adjacent the borehole wall which is itself indicative of the state of initial stress in such material.

12. The method of claim 11 wherein the separation of points on the borehole wall is measured at a plurality of diameters of the borehole wall arrayed uniformly about the periphery of the borehole wall before and after the cone-shaped opening is cut.

13. The method of claim 9 wherein the step of measuring the strain includes the steps of pressing at least one strain gauge into firm contact with the borehole wall such that points on the strain gauge engage points on the borehole wall and obtaining an initial measurement from the strain gauge, and obtaining a measurement from the strain gauge after the cone-shaped opening has been cut which is indicative of the change in strain on the borehole wall material, which may be related to the release of stress in the material adjacent the borehole.

14. A method of estimating the strain in the earth mass surrounding a borehole comprising the steps of:

(a) cutting a conical slot in the wall of the borehole which extends outwardly from the wall of the borehole at an angle to the axis of the borehole;

(b) measuring the strain in the earth mass surrounding the borehole adjacent to the position at which the conical slot is cut before and after the conical slot is cut.

15. The method of claim 14 wherein the step of measuring the strain includes the steps of measuring the separation of two points on the borehole wall at a selected location on the wall just below the position at which the conical slot will be cut, and measuring the separation of the points on the borehole wall at the selected location after the conical slot is cut, whereby the difference in the separation of the selected points on the borehole wall may be related to the release of strain in the material adjacent the borehole wall which is itself indicative of the state of initial stress in such material.

16. The method of claim 14 wherein the step of measuring the strain includes the steps of measuring the initial separation of points on the borehole wall on at least one diameter of the borehole at a position just beneath that at which conical slot will be cut, and measuring the separation of the points on the diameter after the conical slot has been cut, whereby the change in the separation of the points may be related to the release of strain in the material adjacent the borehole wall which is itself indicative of the state of initial stress in such material.

17. The method of claim 16 wherein the separation of points on the borehole wall is measured at a plurality of diameters of the borehole wall arrayed uniformly about the periphery of the borehole wall before and after the conical slot is cut.

18. The method of claim 14 wherein the step of measuring the strain includes the steps of pressing at least one strain gauge into firm contact with the borehole wall such that points on the strain gauge engage points on the borehole wall and obtaining an initial measurement from the strain gauge, and obtaining a measurement from the strain gauge after the conical slot has been cut which is indicative of the change in strain on the borehole wall material, which may be related to the release of stress in the material adjacent the borehole.

19. The method of claim 14 wherein the step of measuring the strain includes the steps of measuring the separation of axially and radially spaced points on the borehole wall at a location just beneath the position at which the conical slot will be cut, and measuring the separation between the axially and the radially spaced points on the borehole wall after the conical slot has been cut, whereby the change in separation of the axially and radially spaced points may be related to the release of strain in radial and axial directions on the material surrounding the borehole and which may be further related to the release of stress on the material.

20. Apparatus for estimating the in situ state of stress surrounding a borehole comprising:

(a) an elongated main support housing adapted for insertion in a borehole and having a central axis;

(b) at least one cutting arm having cutting bits thereon;

(c) means for pivotally mounting the cutting arm to the main support housing;

(d) means for selectively driving the cutting arm inwardly and outwardly about its pivotal mounting to the main support housing;

(e) an inner stem received in the cutting arm and mounted for inward and outward movement with respect thereto;

(f) a cutting head mounted on the end of the inner stem;

(g) means for selectively driving the inner stem and cutting head inwardly and outwardly with respect to the cutting arm;

(h) displacement sensor means, mounted to the support housing at a position just adjacent and below the position of the cutting heads when they are withdrawn toward the support housing, for measuring the changes in separation of selected points on the borehole wall, and (i) means for rotating the cutting arm about the axis of the support housing.

21. The apparatus of claim 20 wherein the displacement sensor means measures changes in the separation of selected radially and axially spaced points on the borehole wall and provides output signals indicative thereof.

22. The apparatus of claim 20 wherein the displacement sensor means includes a pair of radially extendable shoes mounted in a cylindrical case in the main support housing and having strain gauge displacement sensors on the outer surfaces thereof to sense the changes in the dimensions of the borehole wall when it is pressed tightly thereagainst.

23. The apparatus of claim 20 wherein the displacement sensor means includes a plurality of radially extendable probes arrayed about the main support housing in position to sense the radial dimensions of the borehole, each of the probes having a rounded probe head extending from a piston which rides within a cylinder mounted within the main housing, means for selectively and resiliently urging the pistons outwardly in the cylinders until the probe heads contact the borehole wall and are resiliently held thereagainst, and means for measuring the position of the probe heads relative to the main housing.

24. The apparatus of claim 20 wherein the means for pivotally mounting the cutting arm to the main support housing includes an axially stationary base having a stationary bearing portion mounted to the main support housing and a rotatable bearing portion rotating in contact therewith to which the cutting arm is pivotally connected.

25. The apparatus of claim 24 wherein at least two cutting arms are pivotally connected to the rotatable bearing portion of the stationary base.

26. The apparatus of claim 24 wherein each cutting arm includes a tubular outer stem pivotally connected to the rotatable bearing portion of the stationary base at a position on the tubular outer stem adjacent to but spaced away from one end thereof, a rod rotatable within the outer stem and having a portion thereof with outwardly extending threads formed thereon, a beveled drive pinion mounted on an end of the rotatable rod extending outside the outer stem at the end of the outer stem adjacent its pivotal connection to the stationary base, an engagement drive band formed around the circumference of the main support housing at a position such that the beveled pinion and drive band will be in contact when the cutting arm is pivoted outwardly to its desired outermost position, and wherein the inner stem is tubular and hollow and has screw threads formed on the interior surface thereof which mate with the threads on the rotatable rod, whereby, when the drive pinion is engaged with the drive band, the rotation of the cutting arms about the main housing will provide a relative motion between the drive pinion and drive band and the resulting torque on the drive pinion will be transmitted through the rotatable rod to drive the inner stem inwardly or outwardly depending on the direction of rotation of the cutting arms with respect to the main support housing.

27. The apparatus of claim 24 including means for centralizing the main support housing in place within the borehole.

28. The apparatus of claim 24 including a pair of bearing shoes mounted to the support housing and operable to extend into contact with the sides of the borehole to lock the support housing in position and to prevent axial and rotational movement of the support housing.

* * * * *